US011378334B2

(12) United States Patent
Chen et al.

(10) Patent No.: US 11,378,334 B2
(45) Date of Patent: Jul. 5, 2022

(54) SPRAY DRUM SYSTEM

(71) Applicant: STANDARD FOODS CORPORATION, Taipei (TW)

(72) Inventors: Chao-Bin Chen, Taoyuan (TW); Chia-Wei Chang, Taoyuan (TW)

(73) Assignee: STANDARD FOODS CORPORATION, Taipei (TW)

( * ) Notice: Subject to any disclaimer, the term of this patent is extended or adjusted under 35 U.S.C. 154(b) by 96 days.

(21) Appl. No.: 17/118,554

(22) Filed: Dec. 10, 2020

(65) Prior Publication Data

US 2021/0356207 A1 Nov. 18, 2021

(30) Foreign Application Priority Data

May 14, 2020 (TW) ..... 109205933

(51) Int. Cl.
*F26B 5/00* (2006.01)

(52) U.S. Cl.
CPC ..... *F26B 5/00* (2013.01)

(58) Field of Classification Search
CPC ..... F26B 5/00
USPC ..... 34/95
See application file for complete search history.

(56) References Cited

U.S. PATENT DOCUMENTS 2,195,371 A * 3/1940 Moore ..... A23N 12/02 134/67
3,742,611 A * 7/1973 Koller ..... B01D 1/18 34/318
3,815,178 A * 6/1974 Goldman ..... D01G 11/02 19/205
3,870,583 A * 3/1975 Gidge ..... A01G 13/0287 428/17
4,628,619 A * 12/1986 Janusch ..... C10F 5/00 34/330
4,693,911 A * 9/1987 Moreau ..... B05C 19/04 427/205
5,426,866 A * 6/1995 Rumocki ..... F26B 3/12 210/609
5,728,361 A * 3/1998 Holley ..... C10B 53/07 423/449.6
6,363,625 B1 * 4/2002 Niemi ..... E01C 19/1036 432/106

(Continued)

FOREIGN PATENT DOCUMENTS

EP 1378792 A3 * 7/1988
SU 0155927 B1 * 2/1988

*Primary Examiner* — Stephen M Gravini
(74) *Attorney, Agent, or Firm* — CKC & Partners Co., LLC

(57) ABSTRACT

A spray drum system includes a drum drying device and a spray device. The spray device is configured to spray solid particles on the drum drying device. The spray device includes a feeding hopper, a vibrator, a pneumatic conveyor and a high-pressure air source. The feeding hopper is configured to accommodate the solid particles. The vibrator is connected with an output port of the feeding hopper and configured to vibrate the feeding hopper and output the solid particles and control an output rate of the solid particles. The pneumatic conveyor is configured to receive the solid particles output from the vibrator and spray over the drum drying device. The high-pressure air source is connected with the pneumatic conveyor and configured to supply a gas driving force required to transport and spray the solid particles.

7 Claims, 1 Drawing Sheet

(56) References Cited

U.S. PATENT DOCUMENTS

| | | | | |
|---|---|---|---|---|
| 6,428,851 | B1 * | 8/2002 | Friedersdorf | B05D 1/42 427/372.2 |
| 8,800,165 | B2 * | 8/2014 | Kwon | D06F 29/005 68/12.12 |
| 9,022,835 | B1 * | 5/2015 | Gus | B24C 9/006 451/87 |
| 9,446,978 | B2 * | 9/2016 | Spitler | C03B 37/0203 |
| 10,279,287 | B2 * | 5/2019 | Nakata | B01D 33/642 |
| 10,343,188 | B2 * | 7/2019 | Ivanovich Orsyk | B01D 33/073 |
| 2003/0201646 | A1 * | 10/2003 | Kaploun | F03D 9/25 290/54 |
| 2009/0218256 | A1 * | 9/2009 | Rasmussen | B07B 1/22 209/291 |
| 2010/0051058 | A1 * | 3/2010 | Cotter | D06F 31/00 134/115 R |
| 2011/0162424 | A1 * | 7/2011 | Seidel | B26B 13/28 72/38 |
| 2017/0043896 | A1 * | 2/2017 | Fernandez | A61J 7/0053 |
| 2021/0356207 | A1 * | 11/2021 | Chen | F26B 5/00 |

* cited by examiner

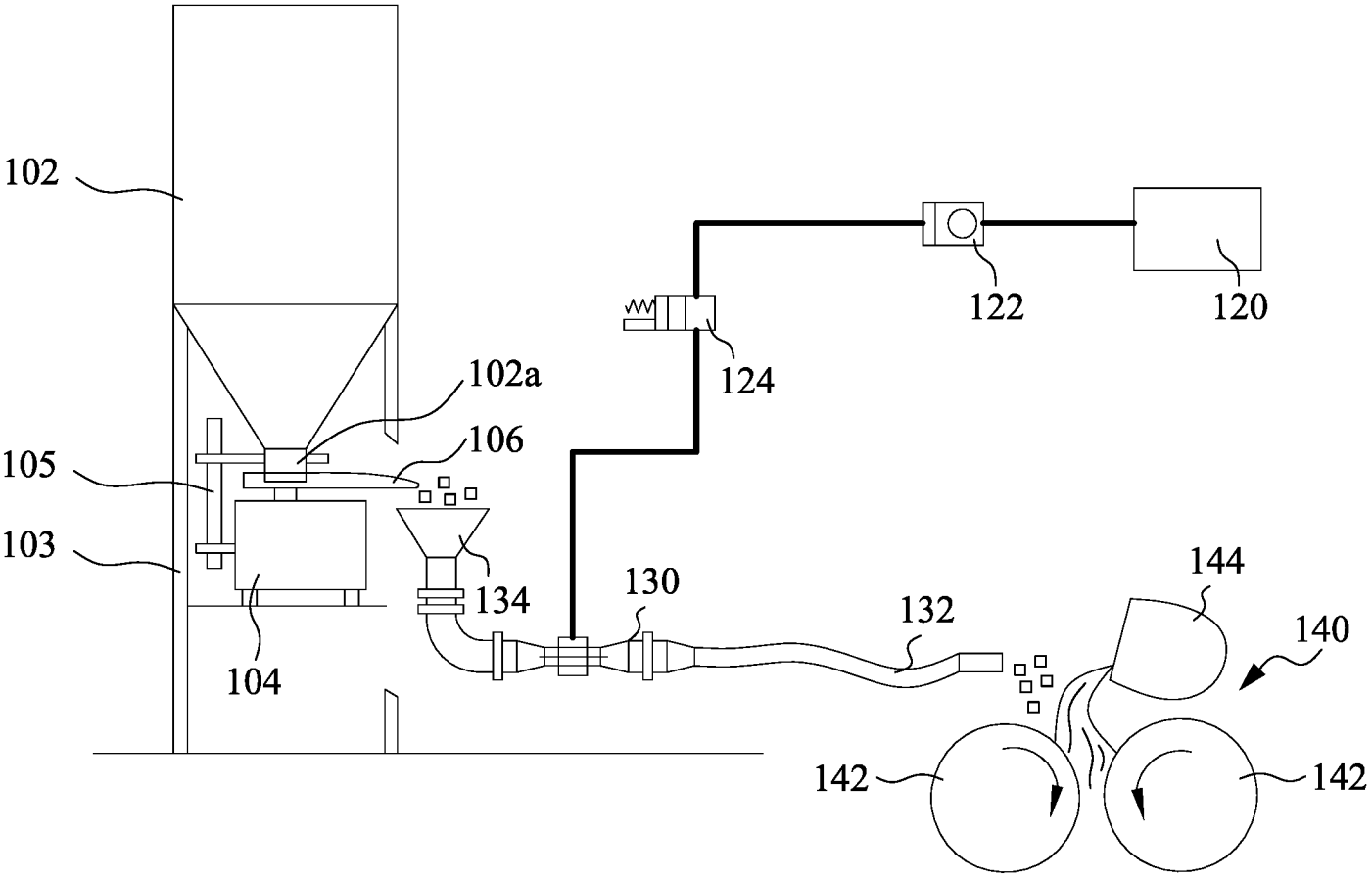
100
102
105
103
102a
106
104
134
130
124
132
122
120
144
140
142
142

SPRAY DRUM SYSTEM

CROSS-REFERENCE TO RELATED APPLICATION

This application claims priority to Taiwan Application Serial Number 109205933, filed May 14, 2020 which is herein incorporated by reference in its entirety.

BACKGROUND

Field of Invention

The present disclosure relates to a spray drum system for manufacturing a dry food.

Description of Related Art

Most food products such as baby rice malt extract contain powders of consistent color. Because the color of the various raw materials of the product and the natural solid particle materials after a long time of mixing, stirring and heating, the color of the solid particle materials would have disappeared eventually, and the nutrients in the solid particles cannot be completely preserved. Therefore, suppliers of related products need to develop an innovative spray drum system to solve the above-mentioned problems.

SUMMARY

In one or more embodiments, a spray drum system includes a drum drying device and a spray device. The spray device is configured to spray solid particles on the drum drying device. The spray device includes a feeding hopper, a vibrator, a pneumatic conveyor and a high-pressure air source. The feeding hopper is configured to accommodate the solid particles. The vibrator is connected with an output port of the feeding hopper and configured to vibrate the feeding hopper and output the solid particles and control an output rate of the solid particles. The pneumatic conveyor is configured to receive the solid particles output from the vibrator and spray over the drum drying device. The high-pressure air source is connected with the pneumatic conveyor and configured to supply a gas driving force required to transport and spray the solid particles.

In one or more embodiments, the spray device further includes a solenoid valve connected between the high-pressure air source and the pneumatic conveyor and configured to control a timing to pass or pause airflows from the high-pressure air source.

In one or more embodiments, the spray device further includes a filter pressure regulation and lubrication control valve connected between the high-pressure air source and the solenoid valve to separate moisture and impurities in the airflows, control an air pressure, and supply lubrication oil.

In one or more embodiments, the pneumatic conveyor further includes a receiving hopper configured to receive the solid particles output from the vibrator.

In one or more embodiments, the vibrator further includes a feeding tray located below the output port of the feeding hopper, and configured to vibrate and feed the solid particles to the receiving hopper.

In one or more embodiments, the pneumatic conveyor further includes a hose configured to convey the solid particles to the drum drying device.

In one or more embodiments, the drum drying device includes two drums.

In sum, the spray drum system disclosed herein includes a drum drying device and a spray device. The spray device is used to spray the solid particles with natural color directly onto the food slurry on the drum such that the drum drying device presses the solid particles and the food slurry together into flakes and dries and sterilizes them, which not only keep the solid particles with natural color in the finished product but also provide consumers with richer nutrition and better food safety. If the color food chips are mixed by a dry mixing process, there is a risk of contamination, and the purchased color chips (vegetable chips or fruit chips) are not subjected to high heat treatment.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows:

FIG. 1 illustrates a spray drum system according to one embodiment of the present disclosure.

DETAILED DESCRIPTION

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1, which illustrates a spray drum system according to one embodiment of the present disclosure. A spray drum system 100 includes a drum drying device 140 and a spray device. The spray device is used to spray solid particles of food over the drum drying device. The drum drying device 140 includes two drums 142 and a pouring device 144 etc. The pouring device 144 is used to inject a properly-formulated food slurry (such as starch slurry, etc.) on the two drums 142. When the heated drums 142 rolls, the food slurry adhered to a surface of each drum 142 may be heated and dried. After heating for a proper time, dried flakes of the food slurry may be scraped off the surface of the drums 142, and then the subsequent process can be continued. The drum drying device 140 shown in the FIGURE is just an example. The size of the two drums may be different (for example, a large drum with a small drum). The two drums are not limited to horizontal arrangement (for example, a small drum may be located above a large drum). The rolling directions of the two drums are not limited to the directions shown in the FIGURE (for example, the two drums may roll in directions opposite to the directions in the FIGURE).

The spray device includes a feeding hopper 102, a vibrator 104, a pneumatic conveyor 130, a high-pressure air source 120, and so on. The feeding hopper 102 is used to accommodate the solid particles of food to be sprayed. The feeding hopper 102 includes a cone-shaped part to control an output rate of the solid particles. A bottom end of the cone-shaped part is an output port 102*a*. The support frame 103 is used to fix the feeding hopper 102 above the vibrator 104.

The vibrator 104 has an L-shaped connection arm 105 coupled to the output port 102*a* of the feeding hopper 102. When the vibrator 104 operates, it can drive the feeding hopper 102 to vibrate synchronously, and then output the solid particles through the output port 102*a*. The vibrator 104 also includes a feeding tray 106 below the output port 102*a* of the feeding hopper 102. When the vibrator 104 operates, the synchronously vibrating feeding tray 106 receives the solid particles from the output port 102*a*, and controls a vibration frequency to regulate a feed rate of the solid particles to a receiving hopper 134.

The pneumatic conveyor 130 is used to receive the solid particles output by the vibrator 104, and conveys and sprays the solid particles to the drum drying device 140. A left end of the pneumatic conveyor 130 is provided with a receiving hopper 134 for receiving the solid particles output by the feeding tray 106 of the vibrator 104. A right part of the pneumatic conveyor 130 is a hose 132 for conveying the solid particles to the drum drying device 140. A spray end of the hose 132 may be fixed to a spray rack (not shown in the FIGURE) to spray solid particles onto the drum drying device 140.

The high-pressure air source 120 is connected to the pneumatic conveyor 130 to provide the gas driving force required to transport the solid particles. The system may be equipped with a solenoid valve 124, which is connected between the high-pressure air source 120 and the pneumatic conveyor 130 to control a timing to pass or pause airflows from the high-pressure air source so as to control a spraying rate of the solid particles. The system may be additionally equipped with a filter pressure regulation and lubrication control valve 122, which is connected between the high-pressure air source 120 and the solenoid valve 124. The filter pressure regulation and lubrication control valve 122 has the function of separating moisture and impurities in the airflows output by the high-pressure air source 120 and supplying lubrication oil to the solenoid valve 124. It can also control the air pressure entering the pneumatic conveyor 130 to control the spraying rate of the solid particles.

The above spray device is used to spray natural colored solid particles of food onto the undried food slurry adhered to the drums 142 of the drum drying device 140. The solid particles are heated by the drums 142 and rolled into thin slices and heated for an appropriate time. Therefore, the food slurry and solid particles are thermally treated with high temperatures, which can effectively kill the harmful bacteria in the product, and ensure food safety of infants, and keep the natural color and nutrients of the solid particles in the finished product.

In summary, the spray drum system disclosed herein includes a drum drying device and a spray device. The spray device is used to spray the solid particles with natural color directly onto the food slurry on the drum such that the drum drying device presses the solid particles and the food slurry together into flakes and dries and sterilizes them, which not only keep the solid particles with natural color in the finished product but also provide consumers with richer nutrition and better food safety. If the color food chips are mixed by a dry mixing process, there is a risk of contamination, and the purchased color chips (vegetable chips or fruit chips) are not subjected to a proper heat treatment.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A spray drum system comprising:

a drum drying device; and a spray device configured to spray solid particles on the drum drying device, wherein the spray device comprises:

a feeding hopper configured to accommodate the solid particles;

a vibrator connected with an output port of the feeding hopper and configured to vibrate the feeding hopper and output the solid particles and control an output rate of the solid particles;

a pneumatic conveyor configured to receive the solid particles output from the vibrator and spray over the drum drying device; and a high-pressure air source connected with the pneumatic conveyor and configured to supply a gas driving force required to transport and spray the solid particles.

2. The spray drum system of claim 1, wherein the spray device further comprises a solenoid valve connected between the high-pressure air source and the pneumatic conveyor and configured to control a timing to pass or pause airflows from the high-pressure air source.

3. The spray drum system of claim 2, wherein the spray device further comprises a filter pressure regulation and lubrication control valve connected between the high-pressure air source and the solenoid valve to separate moisture and impurities in the airflows, control an air pressure, and supply lubrication oil.

4. The spray drum system of claim 1, wherein the pneumatic conveyor further comprises a receiving hopper configured to receive the solid particles output from the vibrator.

5. The spray drum system of claim 4, wherein the vibrator further comprises a feeding tray located below the output port of the feeding hopper, and configured to vibrate and feed the solid particles to the receiving hopper.

6. The spray drum system of claim 1, wherein the pneumatic conveyor further comprises a hose configured to convey the solid particles to the drum drying device.

7. The spray drum system of claim 1, wherein the drum drying device comprises two drums.

* * * * *